US005276925A

United States Patent [19]

Blaha

[11] Patent Number: 5,276,925

[45] Date of Patent: Jan. 11, 1994

[54] RETRACTABLE URINAL FOR TOILET SEAT

[76] Inventor: Frank Blaha, 81-61 Utopia Pkwy., Jamaica Estates, N.Y. 11432

[21] Appl. No.: 991,957

[22] Filed: Dec. 17, 1992

[51] Int. Cl.[5] ..... E03D 9/00

[52] U.S. Cl. ..... 4/300.3; 4/DIG. 5

[58] Field of Search ..... 4/144.1, 144.2, 235, 4/239, 246.1, 246.2, 246.5, 253, 300.3, 315, 307, 462, 463, 480, 483, 484, 667, DIG. 5, 4/301, 661

[56] References Cited

U.S. PATENT DOCUMENTS

| | | | |
|---|---|---|---|
| 1,628,830 | 5/1927 | Eastburn | 4/239 |
| 1,652,304 | 12/1927 | Fischer | 4/239 X |
| 2,577,028 | 12/1951 | McMorrow | 4/DIG. 5 |
| 2,583,718 | 1/1952 | Walls | 4/300.3 |
| 3,193,845 | 7/1965 | Funk | 4/300.3 |
| 3,479,087 | 11/1969 | Burke | 4/239 X |
| 3,500,480 | 3/1970 | Michal, Jr. | 4/301 |
| 4,060,859 | 12/1977 | Anderson | 4/307 |
| 4,133,062 | 1/1979 | Fulbright, Jr. | 4/462 X |
| 4,348,776 | 9/1982 | Sarjeant | 4/300.3 |

*Primary Examiner*—Robert M. Fetsuga
*Attorney, Agent, or Firm*—Collard & Roe

[57] ABSTRACT

A urinating aid for use with a commode having a bowl and seat including a cover with a front end and a back end. The back end is pivotally connected to the seat. The cover includes a lower lid and an upper lid pivotally connected to the lower lid for movement between an open and a closed position. A collapsible shield is connected to the upper lid and the lower lid. A raising and lowering plate moves the shield between a lowered inoperative position and a raised operative position so that when the upper lid is closed, the shield is in the lowered inoperative position. When the upper lid is opened, the raising and lowering plate moves the shield between the lowered inoperative position and the raised operative position to provide a raised urinating aid.

12 Claims, 4 Drawing Sheets

RETRACTABLE URINAL FOR TOILET SEAT

BACKGROUND OF THE INVENTION

1. Field of the Invention

The present invention relates to a urinating aid for a commode. More particularly, it relates to a toilet seat cover which includes a collapsible splash shield.

2. Prior Art

Cleanliness and hygiene is a primary consideration in a bathroom which requires special cleaners and detergents due to the nature of the bacteria. As is well known and understood in the art, a very common problem, and one of the chief causes of the unsanitary conditions found in the bathroom, particularly associated with men and boys, is the problem of splashing. The splashing causes problems of odor, soil and the like, in most cases behind the toilet seat and on the floor to the rear of the toilet and beneath the toilet tank. These problems can be further exaggerated in hospitals and other large facilities where many people use the bathrooms or where elderly or infirm individuals use the bathrooms.

Various attempts have been made to solve the problems of cleanliness and hygiene. For example, U.S. Pat. No. 4,133,062 discloses a spring loaded lifting apparatus with a retractable splash shield connected to the toilet seat and the rim of the toilet bowl. The connection of the splash shield allows for frontal access to the bowl by a male while shielding the back and sides of the toilet bowl. The entire pivot mechanism for the toilet seat and cover is changed to the new spring loaded system. This not only makes for a displeasing appearance, but the shielding means still leaves open the front half of the toilet bowl thus not completely preventing splashing.

U.S. Pat. No. 3,193,845 discloses a pleated and collapsible splash shield which is secured to both the toilet seat and the toilet bowl. This design also allows for frontal access to the toilet bowl. The splash shield only provides protection when the toilet seat pivots backwardly against the toilet tank. Thus limiting the effectiveness of the shield in that the sides and front of the toilet bowl are not shielded form splashing.

U.S Pat. No. 4,060,859 discloses a retractable splash shield operated by a foot pedal. This shield is entirely connected to the toilet bowl rim and simply extends upward when engaged by the foot pedal. Again, the design involved has a displeasing appearance to the bathroom user and the fact that the shield extends only straight up creates more difficulty for a smaller user.

In the patents discussed, all of the shields involved are connected to the toilet bowl itself. Two of the three references show the shield also connected to the bottom of the toilet seat. This makes it difficult to clean these toilet bowls in that the device would need to be removed to assure proper cleaning. The shields that allow for frontal access to the toilet bowl do not shield the front of the toilet bowl and or the user from splashing. In addition, for the frontal access only shields, there is still no protection against a misdirected stream of urine as is likely to happen, especially with children or infirm individuals.

SUMMARY OF THE INVENTION

It is therefore an object of the present invention to provide a toilet bowl shield which eliminates the splashing of urine from and around the toilet bowl.

It is another object of the present invention to provide a new and useful apparatus for converting a conventional toilet seat and cover into a urinal.

It is yet a further object of the present invention to provide a new and useful apparatus which in a non-use, folds within the toilet seat cover so as to be out of the way, and which will not interfere with the other uses or users of the toilet bowl.

I is still another object of the present invention to provide a new and useful urine splash shield which does not require securing to the toilet bowl itself.

It is another object of the present invention to provide a new and useful urine splash shield which is adjustable to the specific needs of the user.

It is still a further object of the present invention to provide a simple to use and easy to install retractable urinal which is relatively simple in design and inexpensive to manufacture.

The invention described and claimed herein comprises the use of a toilet seat that includes a flexible retractable urinal so that a standard toilet seat may be converted into a urinal merely by lifting up the toilet seat cover. Upon opening the toilet seat cover, a telescoping cone having flexible accordion pleats expands to provide the urinal opening. In addition, the toilet seat cover has a directional sliding means which allows the telescoping cone to be adjusted not only for the height of the user, but also serves to tilt the telescoping cone in such a way to provide for more convenient and easier access to the device.

More specifically, the invention relates to a urinating aid for use with a commode having a bowl and a seat. A cover is provided with a front end and a back end, with the back end being pivotally connected to the seat. The cover includes a lower lid and an upper lid pivotally connected to the lower lid for movement between an open and closed position. A collapsible splash shield is connected to the upper lid and the lower lid. Raising and lowering means moves the shield between a lower inoperative position and a raised operative position so that when the upper lid is closed, the shield is in the lowered inoperative position, i.e., collapsed or sandwiched between the upper lid and the lower lid. When the upper lid is opened, the raising and lowering means moves the shield between the lowered inoperative position and the raised operative position to provide a raised urinating aid.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
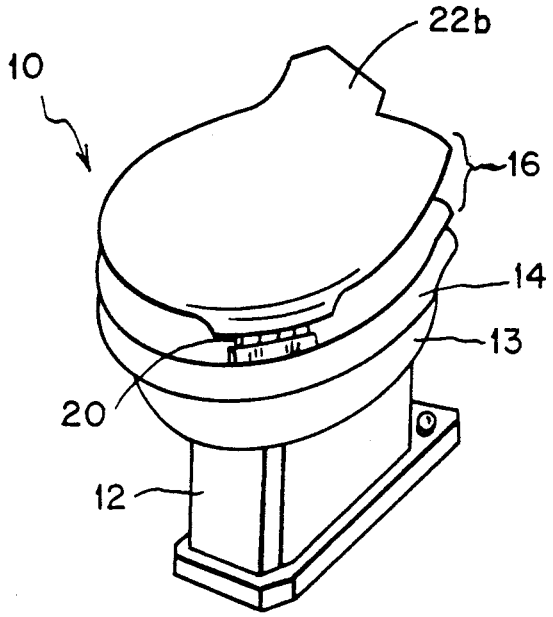
FIG. 1 is a perspective view of a commode with the cover closed.
Figure 2:
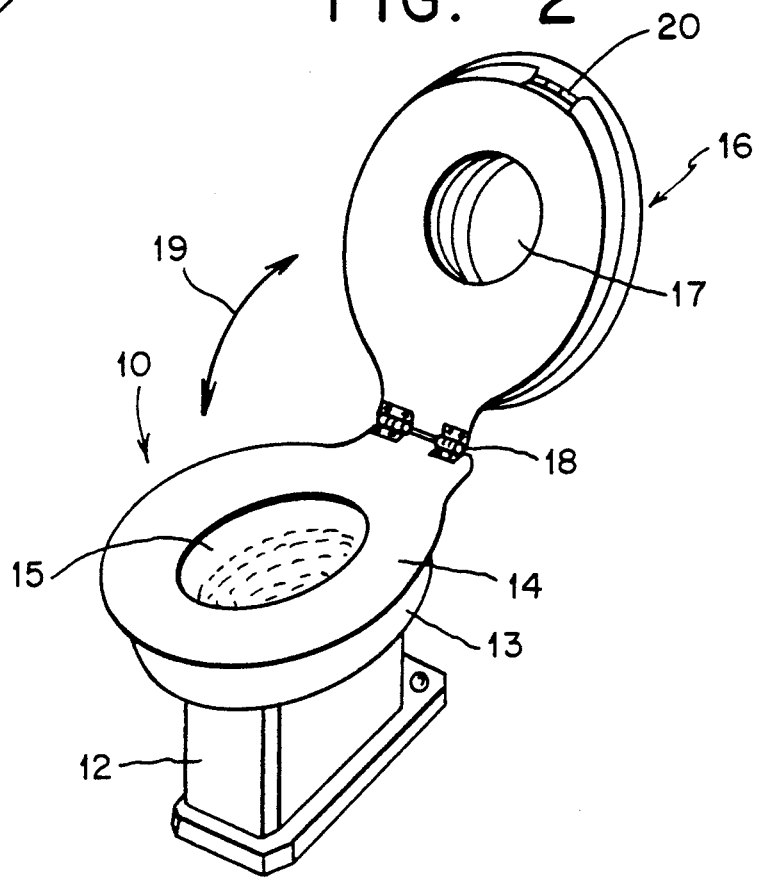
FIG. 2 is a perspective view of the commode with the cover opened.

Referring now to the drawings and, in particular, FIGS. 1 and 2, there is shown a toilet assembly or commode 10 having a toilet bowl 12 attached to the floor in a known manner and operatively coupled to a waste pipe. Toilet bowl 12 is partially filled with water from a tank (not shown for reasons of clarity) and includes an upper rim 13 which supports a seat 14. Seat 14 according to the present invention can be fixed in the horizontal position, as seen in FIGS. 1 and 2, or may be pivotal to an upright vertical position as with conventional seats. Seat 14 in addition contains a central opening 15 as can be seen in FIG. 2.

Figure 3:
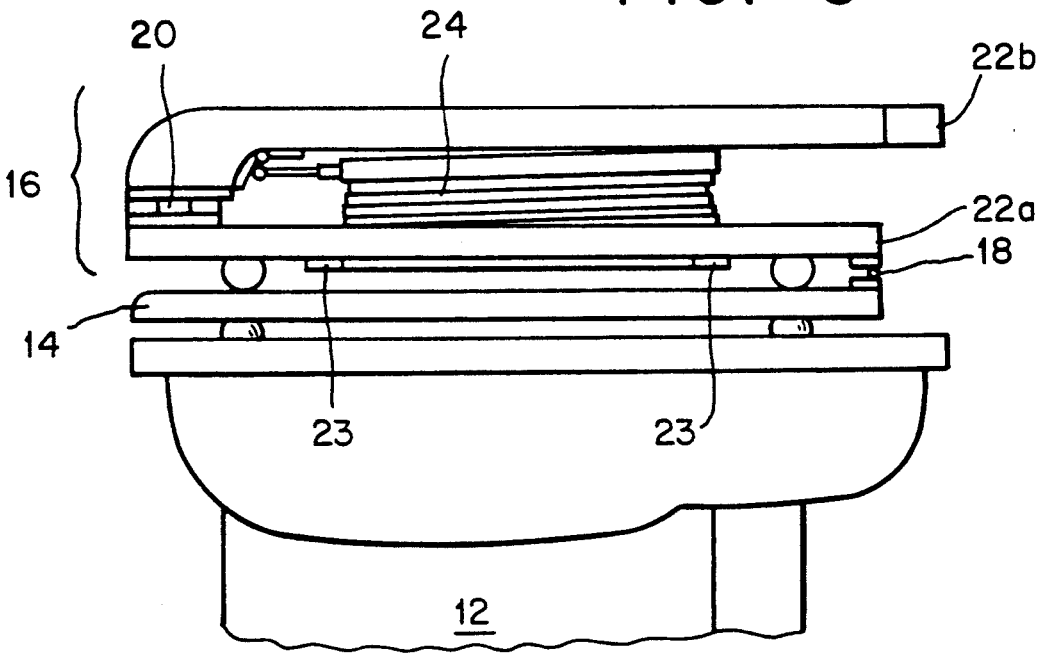
FIG. 3 is a side-elevational view of the commode with the cover closed.
Figure 4:
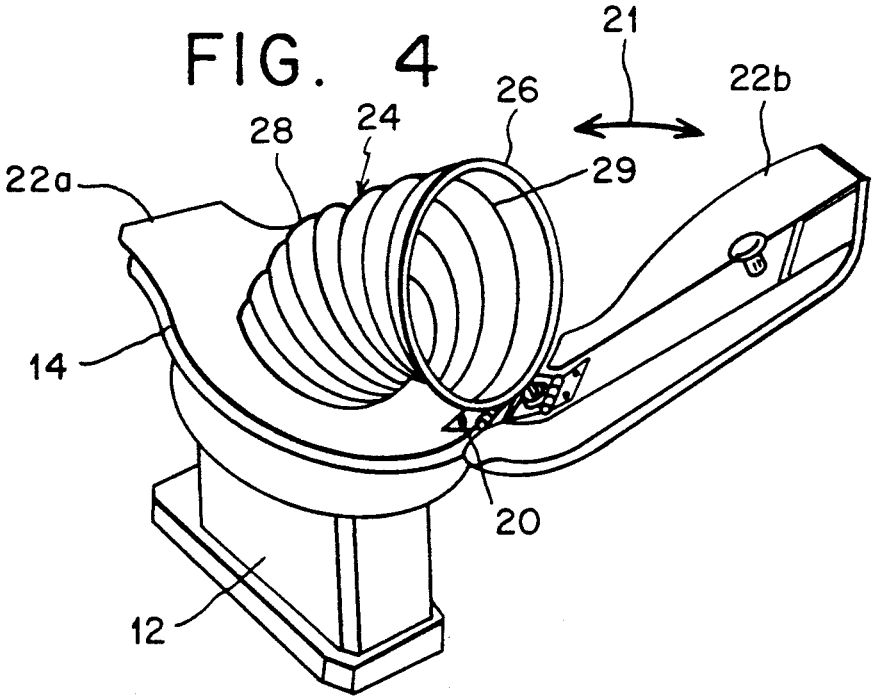
FIG. 4 is a perspective view of the commode with the upper lid open and the splash shield in a lowered inoperative position.

A cover 16 is attached to seat 14 by a main hinge 18 and is movable in direction 19 between a closed position, as shown in FIG. 1, and an open position, as shown in FIG. 2. As can be seen in FIG. 3, cover 16 includes a lower lid 22A and an upper lid 22B which are pivotally connected to each other by an auxiliary hinge 20. From the closed position, as seen in FIG. 1, upper lid 22B can be pivoted in direction 21 to the open position, as seen in FIG. 4. Between lower lid 22A and upper lid 22B, there is located a splash shield 24 made of a flexible tube 28. Splash shield 24 includes an upper end 29 and a circular ring 26.

Figure 5:
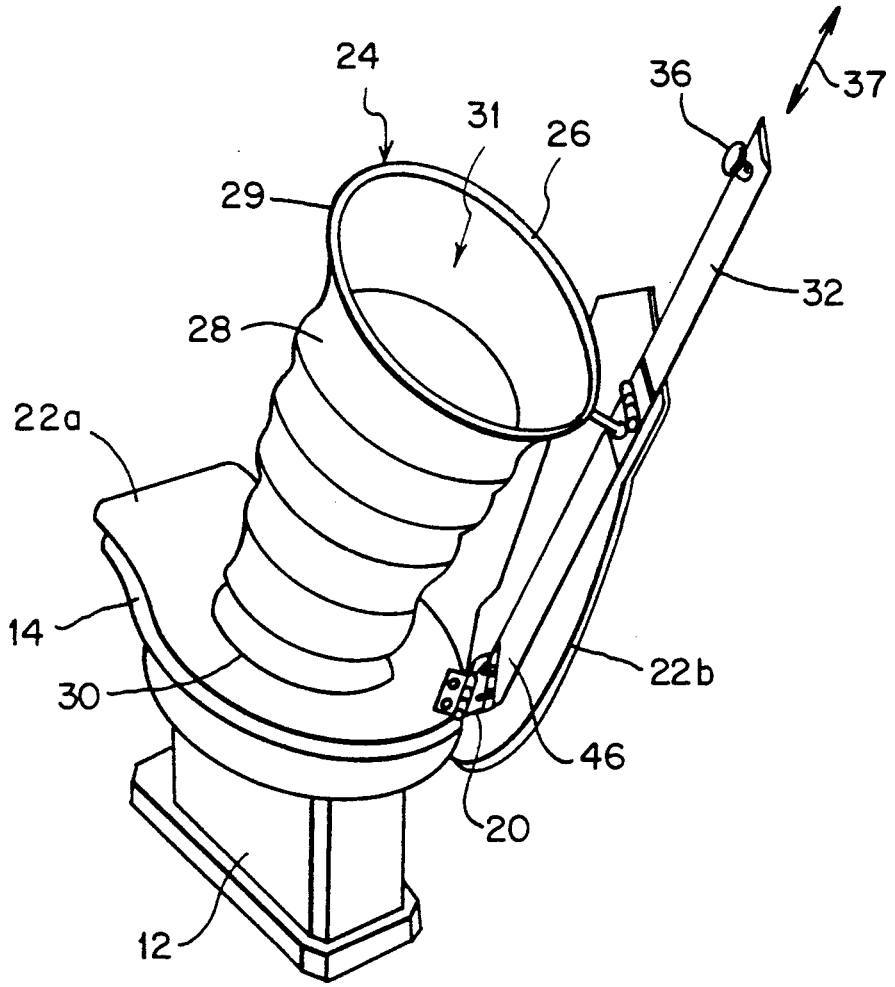
FIG. 5 is a perspective view of the commode with the upper lid open and the splash shield in a raised operative position thereof.

As can be seen in FIG. 5, an extender arm 32 having a handle 36 mounted thereon is slidably disposed within upper lid 22B. The lower end of extender arm 32 is coupled to circular stiff ring 26. Handle 36 is used to move extender arm 32 between the lowered position shown in FIG. 4, and the raised position shown in FIG. 5. In the raised position of FIG. 5, circular ring 26 defines cylindrical opening 31 which extends through the height of splash shield 24 and terminates at circular aperture 17 just above central opening 15, as can be seen in FIG. 2. Circular ring 26 could be adjusted upwardly beyond the position shown in FIG. 5 by a sliding rail which would be located between extender arm 32 and upper lid 22B. The bottom end of splash shield 24 is connected to lower lid 22A.

Figure 6:
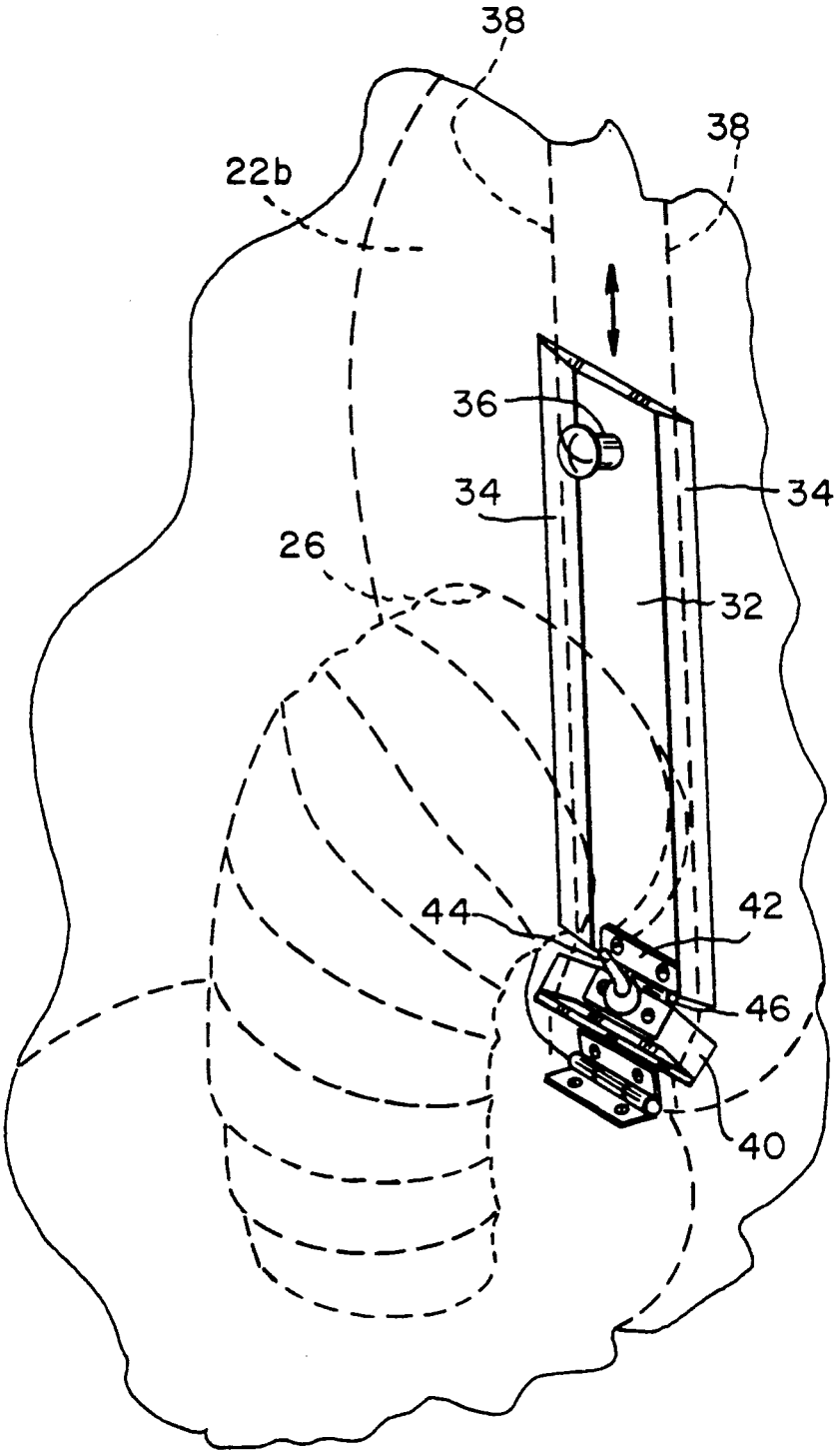
FIG. 6 is a perspective view of the extender arm showing the upper lid and splash shield in phantom line.

As can be seen in FIG. 6, extender arm 32 has bevelled edges 34 which are frictionally retained within guide slots 38 which are formed within upper lid 22B. Extender arm 32 has an articulated member 40 at its lower end. An arm hinge 42 pivotally connects extender arm 32 to articulated member 40. A ring extension 44 extends off the face of articulated member 40 to connect circular ring 26 to articulated member 40. As can be seen in FIGS. 4, 5, and 6, ring extension 44 and circular ring 26 are disposed transverse to the face of articulated member 40.

As can be seen in FIG. 5, the lower portion of upper lid 22B includes a ramp 46 which is adjacent to auxiliary hinge 20. As can be seen in FIG. 6, as extender arm 32 is pushed down, articulated member 40 rides up along ramp 46 to a position perpendicular to extender arm 32. In this orientation, ring extension 44 and circular ring 26 are parallel with extender arm 32.

As can be seen in FIG. 3, ramp 46 allows splash shield 24 to be neatly packed between lower lid 22A and upper lid 22B. Splash shield 24 is collapsed or sandwiched between lids 22A and 22B and circular ring 26 is shown as being adjacent to the bottom surface of upper lid 22B. As upper lid 22B is opened, as seen in FIG. 4, circular ring 26 moves slightly away from upper lid 22B. As extender arm 32 is slid upwards in direction 37, articulated member 40 is removed from ramp 46 and enters guide slots 38 so that it is aligned with extender ar 32. As articulated member 40 enters guide slots 38, circular ring 26 pivots downwardly so that it is oriented transverse to the surface of extender arm 32 and articulated member 40 that it faces. In its fully raised position, as can be seen in FIG. 5, splash shield 24 provides a raised urinating aid.

Splash shield 24 can have a circular, rectangular or square cross section and is accordion pleated. Since cleaning the accordion pleats may be time consuming, splash shield 24 is designed to be readily removable from lower lid 22A and upper lid 22B. Thus, splash shield 24 can be easily removed for cleaning. Splash shield 24 can be made of plastic or rubber and can be removed from lids 22A and 22B and dipped into a cleaning solution and then rinsed off. Alternatively, splash shield 24 can be easily removed from lids 22A and 22B and disposed. If disposable, splash shield 24 could be made from a thin plastic, plastic-coated paper, wax-coated paper, PVC or other inexpensive material.

As can be seen in FIG. 3, splash shield 24 may extend below lower lid 22A and attach to the lower portion of lid 22A with connector means 23. Connector means 23 may consist of snaps, zippers or a hook and loop fastener, for example. The lower surface of lower lid 22A could be equipped with the loop portion of a hook and loop fastener, and the tabs of splash shield 24 could be provided with the hook portions. When splash shield 24 is to be removed for cleaning or simply to be replaced with a new splash shield, the top end of splash shield 24 could be disconnected from ring extension 44 and the lower end could be disconnected from the bottom surface of lower lid 22A. A new splash shield 24 could be put in place, connector means 23 attaching it to lower lid 22A and upper portion being clipped onto ring extension 44. Alternatively, connector means 23 could consist of several snaps located on the bottom surface of lower lid 22A and the corresponding snap on the flaps of the lower portion of splash shield 24. As can be appreciated, splash shield 24 can be connected to articulated member 40 and lower lid 22A in a variety of other ways, as is well known. For example, the lower end of splash shield 24 could be connected to the top portion of lower lid 22A or to the outer edges of lower lid 22A. Similarly, the upper end of splash shield 24 could be clipped, snapped or force-fitted onto ring extension 44 or articulated member 40.

In addition, it should be noted that the position of auxiliary hinge 20 is variable and can be placed at a variety of positions to pivotally connect lower lid 22A and upper lid 22B. In addition, the angle to which upper lid 22B opens to, for example, as seen in FIG. 4, can be variable as well as the angle of guide slots 38 with respect to upper lid 22B. Also, the final position and orientation of the cylindrical opening 31 can be varied, depending on the needs of the users. For example, if splash shield 24 was to be installed in a school where small children would be using the commode, cylindrical opening 31 could be adjusted to have a lower overall height. In addition, the position of cylindrical opening 31 with respect to toilet bowl 12 could be adjusted to accommodate bathrooms having tight quarters, for example, on a boat, or to accommodate infirmed individuals restricted to wheelchairs or who use walkers, etc.

While only a single embodiment of the present invention has been shown and described, it is to be understood that many changes and modifications may be made thereunto without departing from the spirit and scope of the invention as defined in the appended claims.

What is claimed is:

1. A urinating aid for use with a commode having a bowl and a seat pivotally connected to the bowl comprising:

a cover with a front end and a back end, said cover including a lower lid adapted to be pivotally connected to said seat at said back end, and an upper lid pivotally connected to said lower lid for movement between a raised and a lowered position; and a flexible, tubular splash shield connected between said upper lid and said lower lid; and raising and lowering means for moving said shield between a lowered inoperative position and a raised operative position, so that when said upper lid is in said lowered position, said shield is in said lowered inoperative position, and when said upper lid is moved to said raised position, said raising and lowering means moving said shield between said lowered inoperative position and said raised operative position to provide a raised urinating aid.

2. The device according to claim 1, wherein the seat includes a central opening and said lower lid includes an aperture adapted to overlie the central opening.

3. The device according to claim 2, wherein said shield has a bottom end with an opening, said bottom end being connected to said lower lid with the opening aligned with the aperture.

4. The device according to claim 3, wherein said shield includes a top end and a circular stiff ring secured to said top end, said stiff ring being coupled to said raising and lowering means.

5. The device according to claim 4, wherein said raising and lowering means includes a guide slot on said upper lid having a lower section and an extender arm slidably disposed within the guide slot.

6. The device according to claim 5, wherein said extender arm has a lower end including an articulated member, said shield includes a ring extension coupling said ring to said articulated member.

7. The device according to claim 6, wherein said upper lid includes a ramp at the lower section of the guide slot to direct said articulated member between a position aligned with said extender arm and a position approximately perpendicular to said extender arm.

8. The device according to claim 7, wherein said articulated member has a surface and said ring extension and said ring are secured to said articulated member perpendicular to said surface, so that when said articulated member is perpendicular to said extender arm, said ring extension and said ring are parallel to said extender arm and said upper lid.

9. The device according to claim 8, wherein said splash shield is cylindrical.

10. The device according to claim 9, wherein said splash shield is readily removable from said upper lid and said lower lid.

11. The device according to claim 10, wherein said splash shield is made from disposable coated paper.

12. The device according to claim 11, wherein said splash shield has snaps for removably connecting said splash shield to said upper lid and said lower lid.

* * * * *